US010522058B2

(12) United States Patent
Passman

(10) Patent No.: US 10,522,058 B2
(45) Date of Patent: Dec. 31, 2019

(54) GARMENT BADGE HOLDER

(71) Applicant: Passman Enterprises, LLC, Walled Lake, MI (US)

(72) Inventor: Daniel Ira Passman, Farmington Hills, MI (US)

(73) Assignee: Passman Enterprises, LLC, Walled Lake, MI (US)

( * ) Notice: Subject to any disclaimer, the term of this patent is extended or adjusted under 35 U.S.C. 154(b) by 1420 days.

(21) Appl. No.: 14/480,927

(22) Filed: Sep. 9, 2014

(65) Prior Publication Data

US 2016/0071441 A1 Mar. 10, 2016

(51) Int. Cl.

| | |
|---|---|
| ***G09F 3/20*** | (2006.01) |
| ***G09F 21/02*** | (2006.01) |
| ***A41D 27/20*** | (2006.01) |

(52) U.S. Cl.

CPC ..... *G09F 3/207* (2013.01); *A41D 27/201* (2013.01); *G09F 21/02* (2013.01); *G09F 2021/023* (2013.01)

(58) Field of Classification Search

CPC ..... G09F 3/207; G09F 21/02

See application file for complete search history.

(56) References Cited

U.S. PATENT DOCUMENTS

| | | | | |
|---|---|---|---|---|
| 1,467,680 A * | 9/1923 | Oda | A47G 1/12 116/173 |
| 2,589,409 A * | 3/1952 | Leichter | A41D 1/18 2/105 |
| 2,803,829 A | 8/1957 | Tscharner | |
| 2,871,485 A | 2/1959 | Greco | |
| 2,936,460 A | 5/1960 | Jackson | |
| 2,986,743 A * | 6/1961 | Eilen | A41D 27/08 2/247 |
| 3,055,133 A | 9/1962 | Anderson | |
| 3,275,128 A | 9/1966 | Neely | |
| 4,259,797 A | 4/1981 | Belser | |
| 4,266,300 A * | 5/1981 | Partridge | A41D 27/20 2/247 |
| 4,305,215 A | 12/1981 | Smith | |

(Continued)

FOREIGN PATENT DOCUMENTS

| | | |
|---|---|---|
| CN | 201216180 Y | 4/2009 |
| KR | 200396490 Y1 | 9/2005 |
| KR | 20140082162 A | 7/2014 |

OTHER PUBLICATIONS

International Search Report and Written Opinion dated Dec. 10, 2015 regarding PCT Application No. PCT/US2015/048487.

*Primary Examiner* — Richale L Quinn

(74) *Attorney, Agent, or Firm* — Harness, Dickey & Pierce, P.L.C.

(57) ABSTRACT

A garment generally includes a badge that can accessible from an interior of the garment and visible from an exterior of the garment. The garment includes a flap portion formed from a portion of the garment. The flap portion is folded over to form an edge that defines at least a portion of a hole formed in the garment. The garment also includes a generally transparent badge holder having a pocket operable to receive the badge. A fastener attaches the badge holder to the interior of the garment. The badge holder is attached to an interior surface of the garment so that the hole in the garment is disposed on a surface of the badge holder that is opposite the pocket.

16 Claims, 7 Drawing Sheets

(56) References Cited

U.S. PATENT DOCUMENTS 4,316,492 A 2/1982 Plough et al.
4,581,791 A 4/1986 Ong
4,625,337 A * 12/1986 Zahn ..... G09F 3/00 2/247
4,869,004 A 9/1989 Maloney
4,899,395 A * 2/1990 Spector ..... A41D 27/20 2/247
4,924,613 A * 5/1990 Levin ..... A41D 27/08 2/247
5,073,987 A * 12/1991 Crosier ..... A41D 25/00 2/144
5,465,426 A * 11/1995 Beaton ..... A42B 1/248 2/181
5,472,547 A 12/1995 McKye et al.
5,548,847 A * 8/1996 Spicijaric ..... A42B 1/248 2/181
5,791,076 A 8/1998 Gailliard
5,800,900 A * 9/1998 Mitchell ..... A41D 27/08 2/244
D403,835 S 1/1999 Geyer
5,943,698 A * 8/1999 Blanks, I ..... G09F 21/02 2/115
5,953,757 A * 9/1999 Blanks, I ..... A41D 27/08 2/108
5,960,476 A * 10/1999 Danzy ..... A41D 27/08 2/115
6,044,492 A * 4/2000 Krogh ..... A41D 27/08 2/113
6,085,449 A 7/2000 Tsui
6,226,905 B1 5/2001 Osuna
6,240,568 B1 * 6/2001 Lee ..... A41D 27/08 2/195.1
6,470,499 B1 * 10/2002 Joiner ..... A41D 27/08 2/115
7,454,856 B2 * 11/2008 Passman ..... A41D 13/0012 2/247
9,173,441 B2 * 11/2015 Chumbler ..... A41D 27/20
2004/0133967 A1 7/2004 West
2005/0114988 A1 * 6/2005 Dow ..... G09F 21/02 2/247
2007/0107111 A1 * 5/2007 Passman ..... A41D 13/0012 2/247
2014/0026288 A1 1/2014 Passman
2016/0071441 A1 * 3/2016 Passman ..... G09F 3/207 2/69

* cited by examiner

GARMENT BADGE HOLDER

FIELD

The present disclosure relates to a badge holder affixed to a garment and, more specifically, relates to a badge holder having a pocket accessible from an interior of the garment, while a portion of the badge holder remains visible from an exterior of the garment.

BACKGROUND AND SUMMARY

This section provides background information related to the present disclosure which is not necessarily prior art. This section provides a general summary of the disclosure, and is not a comprehensive disclosure of its full scope or all of its features.

Typically, a badge holder is sewn, glued or clipped to an exterior of a garment. The badge holder can have a pocket that receives a card or a badge. The card or the badge can contain information that can, for example, identify an employee with a name and a company name. The pocket is disposed on and only accessible from an exterior of the garment. Motion of the wearer may cause a portion of the garment to gather or bunch, which may cause the pocket to bulge out from the garment. A bulging pocket that extends from the exterior of the garment may have a higher propensity to catch on or snag certain items that could tear or otherwise damage the pocket. Moreover, a pocket that extends from the exterior of the garment may encourage a user to store additional items in the pocket, such as a writing utensil, notepad, paperwork, or personal items, that may at least obscure the card or badge having their name and company name or lead to premature failure of the pocket. Replacement or repair of the pocket may become costly, especially when maintaining a large number of garments.

A successful solution to this problem is provided by commonly-owned U.S. Pat. No. 7,454,856 to Passman, issued on Nov. 25, 2008, which is hereby incorporated by reference. The '856 patent provides an interior-accessible pocket having advantageous construction. However, it has been found that several improvements can be made to provide enhanced performance, comfort, and ease of use.

The present teachings generally include a garment having a badge that is accessible from an interior of the garment and visible from an exterior of the garment. The garment includes a flap portion formed from a portion of the garment. The flap portion is folded over to form an edge that defines at least a portion of a hole formed in the garment. The garment also includes a generally transparent badge holder having a pocket operable to receive the badge. A fastener attaches the badge holder to the interior of the garment. The badge holder is attached to an interior surface of the garment so that the hole in the garment is disposed on a surface of the badge holder that is opposite the pocket.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3A:
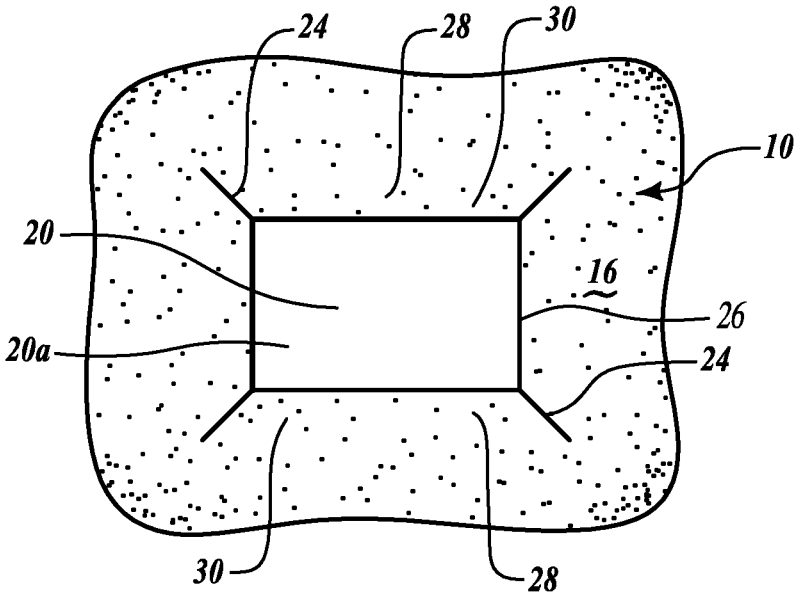
FIG. 3A is a rear view of a portion of an exemplary garment with an initial hole and multiple flap portions formed on the garment constructed in accordance with the present teachings.
Figure 3B:
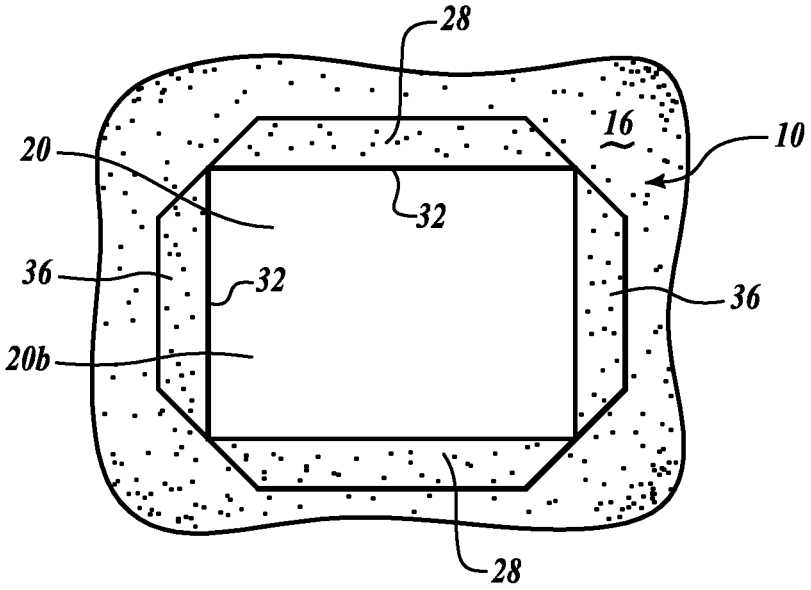
FIG. 3B is similar to FIG. 3A and shows the flap portions folded over to form a finished hole in accordance with the present teachings.
Figure 3C:
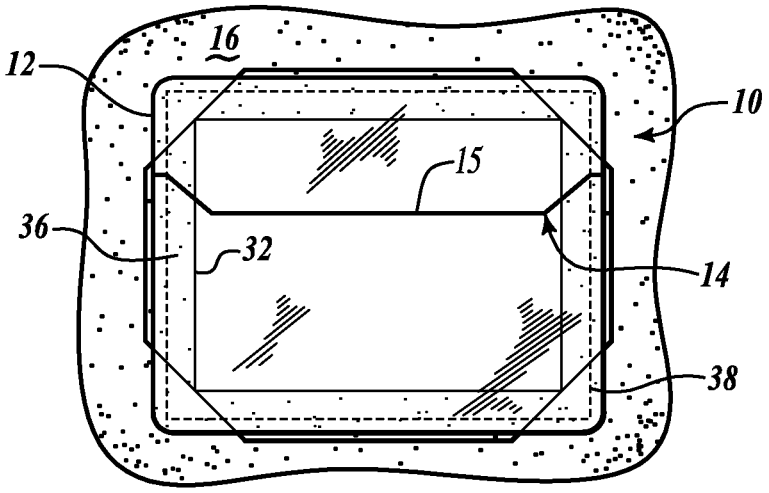
FIG. 3C is similar to FIG. 3B and shows a badge holder according to the first embodiment affixed to an interior of the garment so that the badge is accessible and/or replaceable from the interior of the garment but still visible from the exterior of the garment in accordance with the present teachings.
Figure 3D:
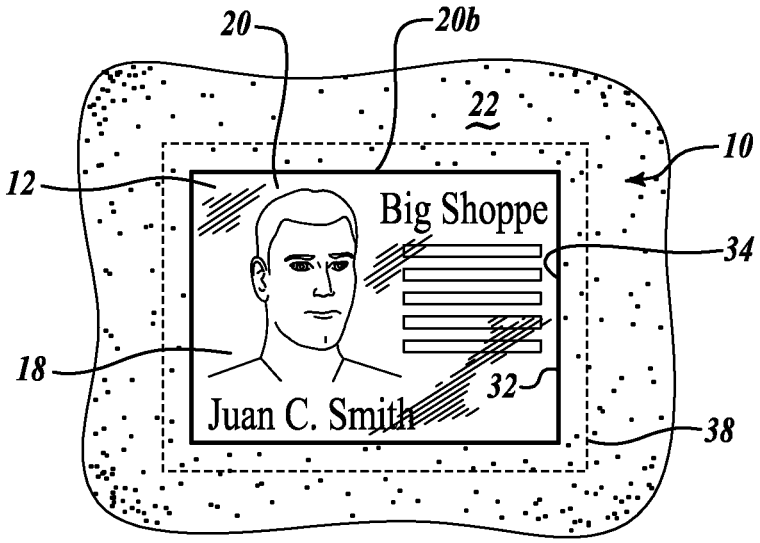
FIG. 3D is a front view of the garment of FIGS. 3C, 3E, and 3F showing the badge through the finished hole in the exterior of the garment that can frame the badge in the badge holder that is affixed to the interior of the garment.
Figure 3E:
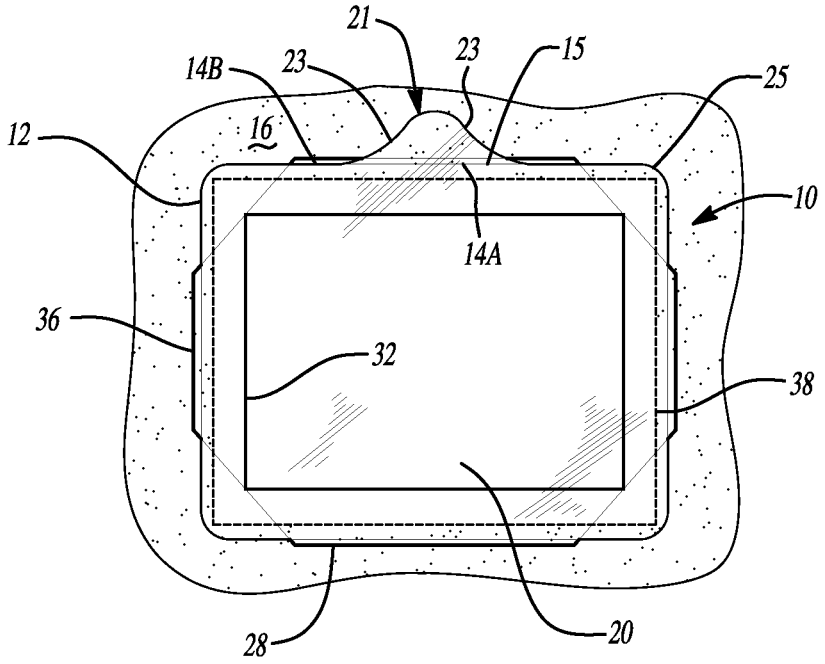
FIG. 3E is similar to FIG. 3B and shows a badge holder according to the second embodiment affixed to an interior of the garment so that the badge is accessible and/or replaceable from the interior of the garment but still visible from the exterior of the garment in accordance with the present teachings.
Figure 3F:
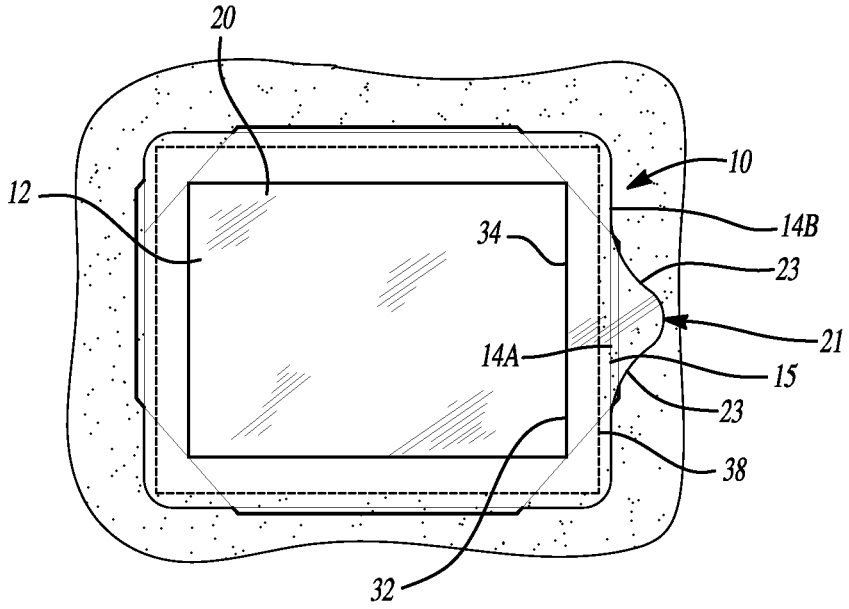
Figure 4:
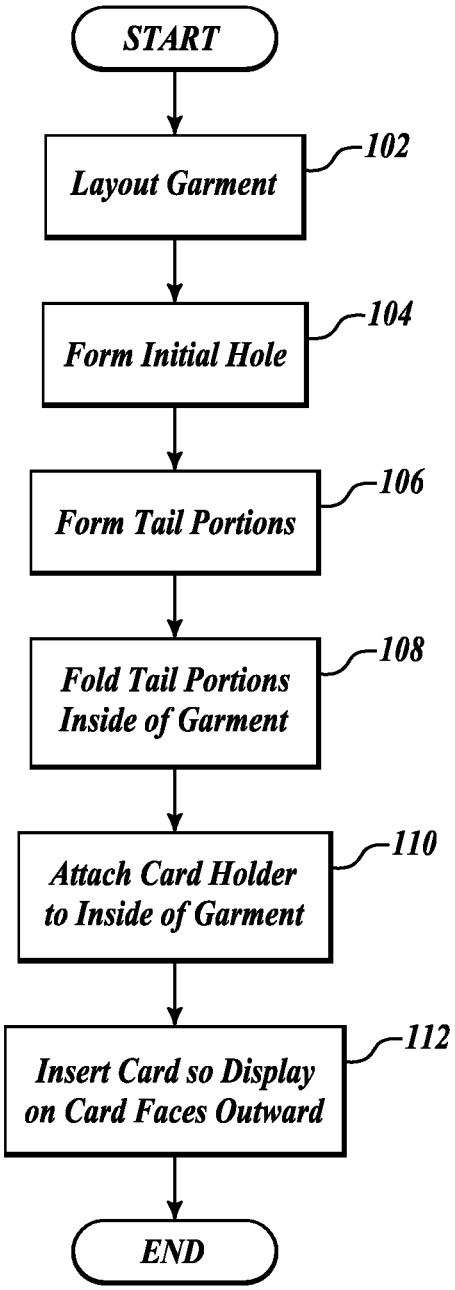

FIG. 3F is similar to FIG. 3B and shows a badge holder according to a third embodiment affixed to an interior of the garment so that the badge is accessible and/or replaceable from the interior of the garment but still visible from the exterior of the garment in accordance with the present teachings; and FIG. 4 is a flow chart showing an exemplary method of forming a finished hole in the exterior of the garment and attaching the badge holder to the interior of the garment in accordance with the present teachings.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "interior," "exterior," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures, unless otherwise specifically noted in the claims. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1A:
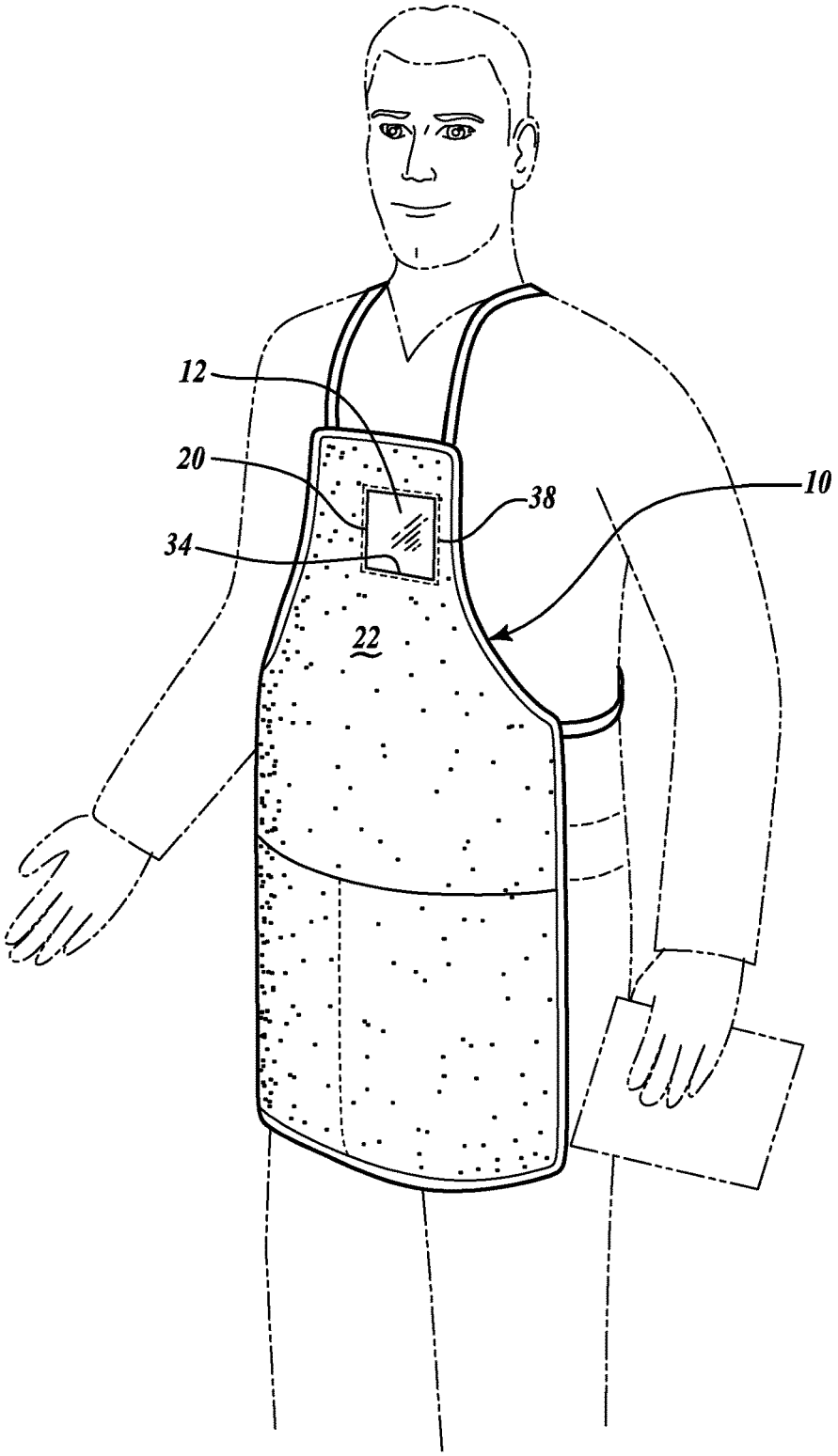
FIG. 1A is a front view of an exterior of a garment with a badge holder affixed to an interior of the garment in accordance with the present teachings.
Figure 1B:
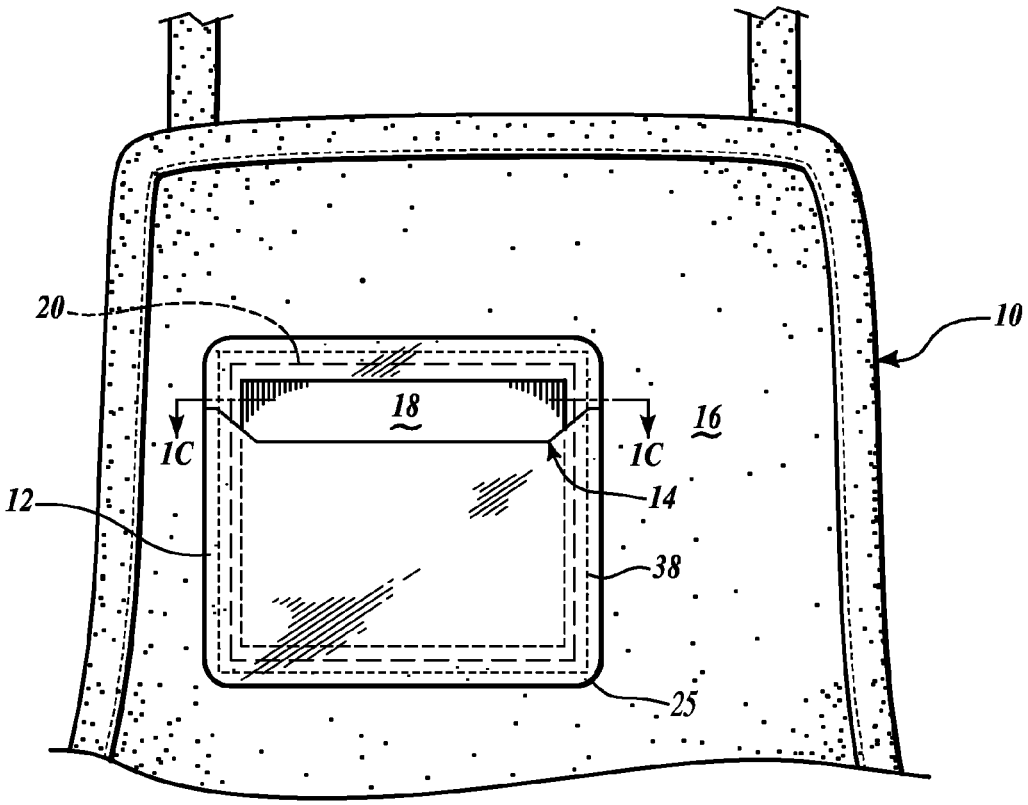
FIG. 1B is a rear view of an interior portion of the garment of FIG. 1A showing the identification badge holder according to a first embodiment affixed to an interior surface of the garment so that a badge that can be placed into the badge holder is accessible from the interior of the garment and can be viewed from the exterior of the garment in accordance with the present teachings.
Figure 1C:
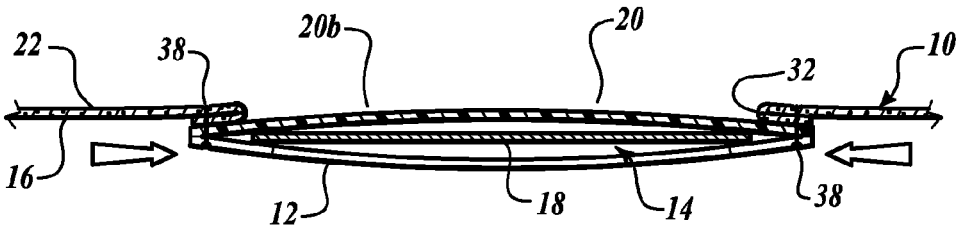
FIG. 1C is a cross-sectional view of the identification badge holder of FIG. 1B showing the badge inserted into the badge holder that is affixed to the interior of the garment and sufficiently compressed to remove the badge.
Figure 1D:
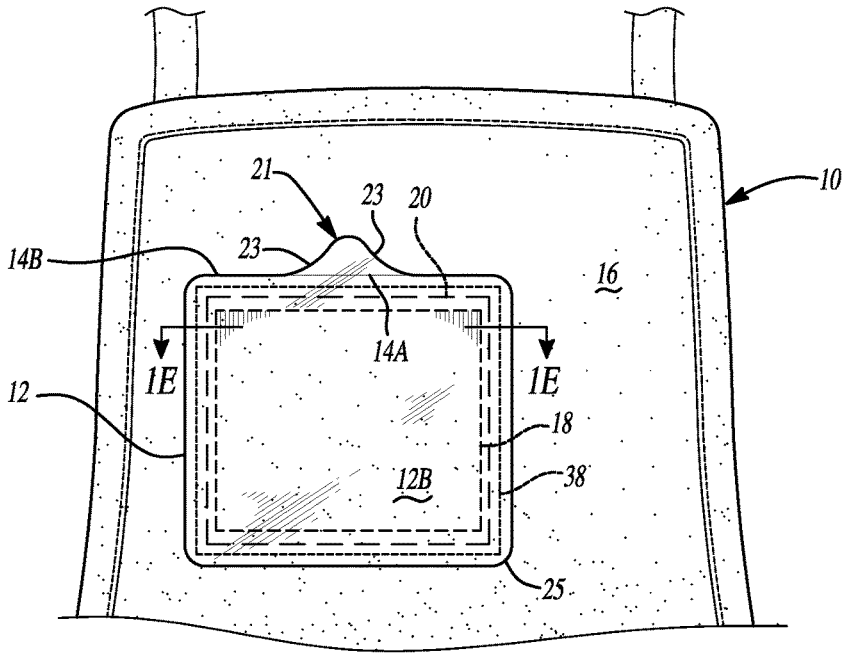
FIG. 1D is a rear view of an interior portion of the garment of FIG. 1A showing the identification badge holder according to a second embodiment affixed to an interior surface of the garment so that a badge that can be placed into the badge holder is accessible from the interior of the garment and can be viewed from the exterior of the garment in accordance with the present teachings.
Figure 1E:
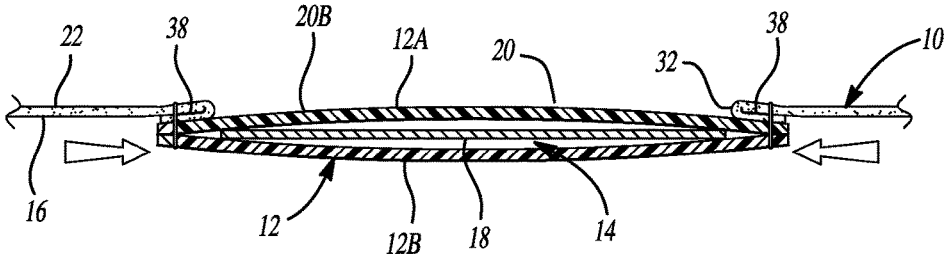
FIG. 1E is a cross-sectional view of the identification badge holder of FIG. 1D showing the badge inserted into the badge holder that is affixed to the interior of the garment and sufficiently compressed to remove the badge.

With reference to FIGS. 1A-1C, the present teachings generally include a garment 10 that can have a badge holder 12 affixed to the garment 10. With reference to FIG. 1B, the badge holder 12 can have a pocket 14 that can be affixed to an interior surface 16 of the garment 10. In this regard, the pocket 14 can be configured to receive a badge 18 (or a card 18, etc.) only from the interior of the garment 10, i.e., the pocket 14 can be configured to only be accessible from the interior surface 16.

In some embodiments, badge holder 12 can define any one of a number of variations. In some embodiments, as illustrated in FIGS. 1B-1E and 3C, 3E, and 3F, badge holder 12 can comprise a transparent exterior panel 12A and an optionally-transparent interior panel 12B that collectively form the pocket 14 for receiving badge 18 therein. Exterior panel 12A and interior panel 12B each has a pocket edge 14A and 14B, respectively, that together define the opening to the pocket 14 that is only accessible from the interior surface 16 of the garment 10. In some embodiments, as illustrated in FIGS. 1B, 1C, and 3C, the pocket edge 14B of interior panel 12B can extend to a position that is below the pocket edge 14A of exterior panel 12A. In this way, a pocket opening 15 is formed that is exposed and/or faces the user of the garment 10. This arrangement may be perfectly functional in many applications.

However, in some applications, the exposed pocket edge 14B of interior panel 12B may snag or otherwise catch on the user's clothing under the garment 10 and/or may not fully support badge 18, thereby permitting damage to badge 18 due to its proximity to the user's clothing and/or perspiration. Accordingly, in some embodiments, as illustrated in FIGS. 1D, 1E, 3E, and 3F, the pocket edge 14B of interior panel 12B can extend to a position that is generally even with or above the pocket edge 14A of exterior panel 12A such that the pocket edge 14B of interior panel 12B exactly follows or overlaps the pocket edge 14A of exterior panel 12A. In this way, a pocket opening 15 is formed that is not exposed nor faces the user of the garment 10. This arrangement protects the user's clothing from possible snags and further protects badge 18 from damage and/or perspiration. It should be noted, as illustrated in FIG. 3F, that in some embodiments, the pocket edge 14B of interior panel 12B can extend to a position that is generally even with or extends to a side of the pocket edge 14A of exterior panel 12A (e.g. to the right when defining a right side pocket opening 15) such that the pocket edge 14B of interior panel 12B again exactly follows or overlaps the pocket edge 14A of exterior panel 12A. It should be appreciated that in the present embodiment, the pocket edge 14B of interior panel 12B extends to a position that is generally even with or greater than the pocket edge 14A of exterior panel 12A. In this way, the surface area of the interior panel 12B is equal to or greater than the surface area of the exterior panel 12A—this is in contrast to the embodiment illustrated in FIGS. 1B, 1C, and 3C.

Accordingly, in some embodiments, such as those illustrated in FIGS. 3C and 3E, badge 18 can be loaded into badge holder 12 via pocket opening 15 that is located along a top portion of badge holder 12. In this way, badge 18 can be slid into opening 15 and retained in position within pocket 14 at least by gravity and friction. Similarly, in some embodiments, as illustrated in FIG. 3F, badge 18 can be loaded into badge holder 12 via pocket opening 15 that is located along a side portion of badge holder 12 (e.g. left side or right side). In this way, badge 18 can be slid into opening 15 and retained in position within pocket 14 at least by gravity and friction. A side entry pocket 14 can be particularly useful in applications where the user will be bending over more frequently, which may cause the badge 18 to be improperly positioned within badge holder 12 in configurations permitting vertical movement thereby resulting in a badge that is not clearly visible from the exterior of the garment. However, in some embodiments, a top entry pocket 14 may be particularly convenient for insertion and access purposes. The benefits of each configuration may vary due to specific use and application.

In some embodiments, interior panel 12B can comprise a tab feature 21 extending therefrom and continuous therewith to permit a user to conveniently grasp the tab feature 21 to reveal the opening of pocket 14 to aid in the insertion of badge 18. Tab feature 21 can be configured such that it extends beyond pocket edge 14A of exterior panel 12A and provides a gripping surface for users. Tab feature 21 can define any one of a number of designs to facilitate convenient grasping or gripping by the user. By way of non-limiting example, in some embodiments, tab feature 21 can define a centrally-disposed enlarged section have an arcuate transition 23 from pocket edge 14B of interior panel 12B. This embodiment provides a number of advantages, such as, but not limited to, removing any sharp corners that can lead to snags, minimizing the exposed edges to the user's clothing (e.g. only pocket edge 14B of interior panel 12B is exposed, as opposed to both pocket edges 14A and 14B of the previous embodiment), and eliminating the visual appearance of pocket edge 14B of interior panel 12B when viewed from the exterior of garment 10 (i.e. through the badge window).

In some embodiments, badge holder 12 can comprise corner features 25. Corner features 25 can comprise any one of a number of shapes that are conducive to the design and use of badge holder 12. In some embodiments, corner features 25 can be angular thereby producing a generally octagonal shape or a rectangular shape having chamfered corners. However, it some embodiments, corner features 25 can be generally arcuate to provide a smooth transition between adjacent edges (see FIGS. 1B and 1D). It should be appreciated that in some embodiments badge holder 12 need not have a finished periphery (e.g. it can remain a rough cut).

With reference to FIGS. 1A, 1B and 1C, the garment 10 can define a hole 20 through which the badge holder 12 may be viewed from the exterior of the garment 10. The hole 20 formed in the garment 10 can be formed in any suitable polygonal shape (e.g. square, rectangle, triangle, pentagon, hexagon, heptagon, octagon, nonagon, decagon, etc.), or other desired shape (e.g. oval, ellipse, circle, etc.). In some embodiments, a generally rectangular shape is formed. The rectangular shape of the hole 20 can define a value of a surface area (i.e., a length and a width) that can be less than that of a value of a surface area of the badge holder 12. The value that defines the surface area of the badge holder 12 can be based on an outer periphery of the badge holder 12. In doing so, the hole 20, when viewed from an exterior surface 22 of the garment 10, can frame the badge holder 12, as shown in FIGS. 1A and 3D.

With reference to FIG. 3A, the hole 20 in the garment 10 can be formed by initially cutting the rectangular or other suitable shaped initial hole 20*a* into the garment 10. Multiple channels 24 can be cut in the garment 10. The channels 24 can be formed so as to extend from a periphery 26 of the initial hole 20*a*. By cutting the channels 24 in the garment 10, one or more flap portions 28 can be formed, as shown in FIG. 3B. The flap portions 28 can also be referred to as tab portions 28 or tail portions 28. It should be understood that in some embodiments, flap portions 28 can be removed during cutting and/or replaced by other trim pieces.

With reference to FIG. 3B, the flap portions 28 can then be folded back such that an interior surface 30 (FIG. 2A) of the flap portions 28 can be folded over to contact a portion of the interior surface 16 of the garment 10 that is adjacent to the hole 20. In this regard, the flap portions 28 can form an edge portion 32. The edge portion 32 can define a portion of the finished hole 20*b* (FIG. 3D) on the garment 10. It will be appreciated in light of the disclosure that the edge portion 32 can form a finished, hemmed or otherwise neat edge that can define a border 34 (FIG. 3D) that can frame the badge holder 12 as viewed from the exterior surface 22 of the garment 10.

With reference to FIG. 3C, the badge holder 12 can be placed in contact with an exterior surface 36 (FIG. 2B) of the flap portions 28 and thus ultimately against the garment 10. The badge holder 12 can also be affixed to a portion of the garment 10 in addition to the flap portions 28, as shown in FIG. 1C. Specifically, a fastener 38 can secure the badge holder 12 against the flap portion 28 and ultimately against the portion of the garment 10 near the flap portions 28. The fastener 38 can define one or more threads for stitching, one or more staples, one or more clips, one or more adhesives, other suitable fasteners and one or more combinations thereof. The fastener 38 can connect the badge holder 12 to the garment 10 so that the flap portions 28 are coupled between a portion of the badge holder 12 and a portion of the interior surface 16 of the garment 10.

With the badge holder 12 installed on the garment 10, the pocket 14 of the badge holder 12, into which the badge 18 can be placed, can be configured to be accessible from the interior surface 16 of the garment 10. From the exterior surface 22 of the garment 10, a portion of the badge holder 12 can remain visible so as to view the badge 18 contained within the badge holder 12 from the exterior of the garment 10. In one example, the finished edge portions 32 that can serve as the border 34 around the badge holder 12. The size and shape of the initial hole 20*a*, the finished hole 20*b* and the border 34 formed from the garment 10 can vary in size and configuration and can be (or need not be) complimentary to the size and configuration of the badge holder 12.

In one example, the badge holder 12 can have an exemplary rectangular size of about four and one-quarter inches by about three and three-quarter inches. One suitable example of the badge holder 12 and the badge 18 are readily available under the Avery® brand. Moreover, the thickness of the flap portions 28 can be about a quarter of an inch. In this regard, the thickness of the flap portions 28 can be defined from the finished edge portion 32 to an original edge of the flap portion 28, i.e., the edge that formed the initial hole 20*a* (FIG. 2A).

Figure 2:
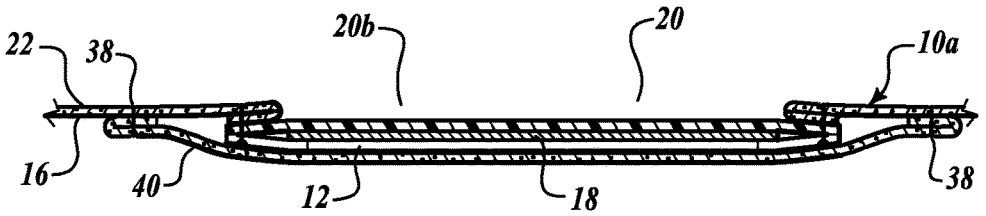
FIG. 2 is similar to FIGS. 1C and 1E and shows a further aspect of the present teachings that includes a protective cover over the badge holder that connects to the interior surface of the garment.

In a further example and with reference to FIG. 2, a cover 40 can be attached over the badge holder 12 on the interior surface 16 of a garment 10*a* so as to provide a softer material (relative to the badge holder 12) over the badge holder 12. In doing so, the garment 10 may be more comfortable to the user because the cover 40 can be shown to at least shield the user from the badge holder 12.

Returning to FIG. 3D, the badge 18 that can be placed in the pocket 14 of the badge holder 12 can be made of various suitable materials such as cardboard, plastic, etc. The badge 18 can contain, for example, a name of the user, a company name, a company logo, etc.

With reference to FIG. 4, an exemplary method is illustrated. The method begins with 102. In 102, the garment 10 is laid out in preparation for forming a hole 20. In one example, a jig or a backing can be designed and/or configured to hold the garment 10 (e.g., a smock or an apron as shown in FIG. 1A) and to receive a cutting tool that can cut the initial hole 20*a* in the garment 10. It will be appreciated in light of the disclosure that the garment 10 must be kept generally flat and held tight during the operation.

In 104, the initial hole 20*a* is formed in the garment 10. A cutting die and press or other suitable cutting mechanism may be used to form the initial hole 20*a* in the garment 10. The initial hole 20*a* may be any suitable shape as outlined herein and may, for example, be a rectangular shape. It will be appreciated that other forms of cutting may be used such as scissors, lasers, reciprocating blades, other suitable cutting mechanisms and combinations thereof.

In 106, the flap portions 28 are formed from a portion of the garment 10 adjacent to the initial hole 20*a* formed in 104 above. The flap portions 28 can be formed by cutting the channels 24 that can extend from the periphery 26 of the initial hole formed in 104. It will be appreciated in light of the disclosure that the channels 24 can be formed in a separate process or in combination with forming the initial hole 20*a* and, therefore, in a single process.

In 108, the flap portions 28 can be folded over to contact the interior surface 16 of the garment 10. Specifically, the interior surface 30 of the flap portions 28 can be folded over to contact the interior surface 16 of the garment 10. The edge portion 32 can be formed at the fold of the flap portion 28. The edge portion 32 can define a periphery that can define the border 34 of the hole 20 (i.e., the finished hole 20*b*) formed on the garment 10.

In 110, the badge holder 12 can be affixed to the interior surface 16 of the garment 10. In one example, the fastener 38 such as thread can be used in a top stitch or other suitable stitch to affix the badge holder 12 directly to the flap portions 28 and additionally to the interior surface 16 of the garment 10 near the hole 20. In this regard, a portion of the badge holder 12 can be framed by the border 34 and thus can remain visible from the exterior surface 22 of the garment 10. In addition, the pocket 14 of the badge holder 12 can remain accessible from the interior surface 16 of the garment 10.

In 112, the badge 18 can be placed in the badge holder 12. It will be appreciated that the card 18 or the badge 18 can be placed in the pocket 14 which can be accessible from the interior surface 16 of the garment 10 while the badge holder 12 and the badge 18 therein can remain visible from the exterior surface 22 of the garment 10. By way of the above example, the border 34 can frame the information that can be displayed on the badge 18 so that is visible from the exterior of the garment 10. From 112, the method ends.

The badge holder 12 as affixed to the garment 10 in accordance with the present teachings can be shown to avoid the problem of having the pocket 14 tear away from a remaining portion of the badge holder 12. It can be shown that affixing the badge holder 12 to the interior surface 16 of the garment 10 can protect the pocket 14 from tearing or other damage but the pocket 14 can still be accessible from the interior of the garment 10 to, for example, exchange the badge 18 from the pocket 14. Moreover, the edge 34 can provide a finished (i.e., hemmed) edge to frame the badge 18 in the badge holder 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A garment having a badge that can identify a wearer of the garment, the badge is accessible from an interior of the garment and is visible from an exterior of the garment, the garment comprising:

a flap portion formed from a portion of the garment that defines a hole, said flap portion folded over to form an flap edge that defines at least a portion of said hole formed in the garment;

a generally transparent badge holder having an exterior panel and an interior panel that forms a pocket operable to receive the badge and only accessible from the interior of the garment, said interior and exterior panels each having a pocket edge that cooperates to form an opening of said pocket, wherein said pocket edge of said interior panel is at least in part disposed above or to a side of said hole formed in said portion of the garment so as not to be visible from the exterior of the garment, said pocket edge of said interior panel further disposed at or overlaps to conceal said pocket edge of said exterior panel when viewed from the interior of the garment; and a fastener attaching said generally transparent badge holder to the interior of the garment by coupling said flap portion between a portion of said badge holder and said portion of the garment near said hole, wherein said generally transparent badge holder is attached to the interior of the garment so that said hole in the garment is disposed on said exterior panel of said badge holder and is opposite said pocket.

2. The garment of claim 1 further comprising a tab feature extending from said pocket edge of said interior panel, said tab feature being graspable to facilitate opening of said pocket.

3. The garment of claim 2 wherein said tab feature defines an arcuate shape.

4. The garment of claim 2 wherein said tab feature is centrally-disposed along said pocket edge of said interior panel.

5. The garment of claim 1 wherein said fastener is one or more threads for stitching, staples, clips, adhesives and combinations thereof.

6. The garment of claim 1 wherein said flap edge that at least partially defines said hole in the garment is hemmed and at least partially frames a portion of the badge in said badge holder.

7. The garment of claim 1 wherein said hole in the garment is sized to fit entirely within a periphery of said generally transparent badge holder.

8. The garment of claim 1 further comprising a cover that extends over said interior panel of said generally transparent badge holder and couples to an interior surface of the garment.

9. The garment of claim 1 wherein an interior surface of said flap portion is folded over into an interior surface of the garment to form said flap edge of said hole in the garment.

10. The garment of claim 1 wherein a member of the garment is operable to extend around a torso of the wearer and a member of the garment is operable to extend around a neck of the wearer.

11. The garment of claim 1 wherein said pocket of said generally transparent badge holder only accepts one badge.

12. A garment having an interior, an exterior and a badge visible from the exterior of the garment that can identify a wearer of the garment, the garment comprising:

a portion of the garment that defines a hole;

a portion of the garment that is operable to extend around a torso of the wearer; and a badge holder having a periphery, said badge holder having a pocket that is operable to accept the badge and only accessible from the interior of the garment, said badge holder having an exterior panel and an interior panel that form said pocket, said interior and exterior panels each having a pocket edge that cooperates to form an opening of said pocket, wherein said pocket edge of said interior panel is at least in part disposed at or overlaps to conceal said pocket edge of said exterior panel when viewed from the interior of the garment.

13. The garment of claim 12 wherein said badge holder further comprises a tab feature extending from the pocket edge of the interior panel, said tab feature being graspable to facilitate opening of said pocket.

14. The garment of claim 12 wherein said badge holder is fixed to the garment with a fastener that attaches said badge holder to the interior of the garment so that said hole in the garment is disposed on said exterior panel of said badge holder.

15. The garment of claim 12 wherein said pocket edge of said interior panel is at least in part disposed above or to a side of said hole formed in said portion of the garment so as not to be visible from the exterior of the garment.

16. The garment of claim 12 further comprising a cover that extends over said interior face of said badge holder and couples to the interior of the garment.

* * * * *